US008470269B2

(12) United States Patent
Chung et al.

(10) Patent No.: US 8,470,269 B2
(45) Date of Patent: Jun. 25, 2013

(54) HIGHLY EFFICIENT URANIUM LEACHING METHOD USING ULTRASOUND

(75) Inventors: Kyeong-Woo Chung, Daejeon (KR); Chul-Joo Kim, Daejeon (KR); Ho-Sung Yoon, Seoul (KR)

(73) Assignee: Korea Institute of Geoscience and Mineral Resources, Daejeon (KR)

( * ) Notice: Subject to any disclaimer, the term of this patent is extended or adjusted under 35 U.S.C. 154(b) by 0 days.

(21) Appl. No.: 13/099,089

(22) Filed: May 2, 2011

(65) Prior Publication Data

US 2012/0134901 A1 May 31, 2012

(30) Foreign Application Priority Data

Nov. 26, 2010 (KR) ..... 10-2010-0119086

(51) Int. Cl.

| | |
|---|---|
| ***B01D 11/00*** | (2006.01) |
| ***B01F 1/00*** | (2006.01) |
| ***C01G 43/00*** | (2006.01) |
| ***C01G 56/00*** | (2006.01) |
| ***C22B 60/02*** | (2006.01) |

(52) U.S. Cl.
USPC ..... 423/20; 423/658.5; 75/398; 210/748.05; 210/748.01

(58) Field of Classification Search
USPC ..... 423/20, 658.5; 75/398; 210/748.05, 210/748.01
See application file for complete search history.

(56) References Cited

U.S. PATENT DOCUMENTS

| | | | | |
|---|---|---|---|---|
| 3,268,288 | A * | 8/1966 | Goren | 423/18 |
| 3,488,162 | A * | 1/1970 | Sierzputowski | 423/20 |
| 4,361,541 | A * | 11/1982 | Bings et al. | 423/20 |
| 4,425,307 | A | 1/1984 | DeVries | |
| 4,764,353 | A | 8/1988 | Babjak et al. | |
| 5,573,738 | A * | 11/1996 | Ma et al. | 423/20 |
| 7,128,840 | B2 * | 10/2006 | Wai et al. | 210/634 |
| 2009/0250408 | A1 | 10/2009 | Xie et al. | |
| 2011/0076836 | A1 * | 3/2011 | Tauzin | 438/458 |

FOREIGN PATENT DOCUMENTS

| | | | |
|---|---|---|---|
| JP | 6-116660 | A | 4/1994 |
| JP | 2004-36000 | A | 2/2004 |
| JP | 2004-504494 | A | 2/2004 |
| KR | 1019830010209 | A | 12/1983 |
| KR | 101998703193 | A | 10/1998 |
| RO | 122642 | B1 * | 10/2009 |
| WO | WO 2006/007265 | A2 | 1/2006 |

OTHER PUBLICATIONS

Seung-Ah Lee et al., "Nonferrous Metals Metallurgy", Jan. 25, 1999, pp. 6-1-6-6, Munwundang Publishing Company.
"The 6th International Conference on Separation Science and Technology", Oct. 26-28, 2010, pp. 1-6, Changsha, Hunan, China.

(Continued)

*Primary Examiner* — Melissa Stalder

(57) ABSTRACT

A highly efficient uranium leaching method using ultrasound is disclosed. The uranium leaching method includes preparing black slate powder containing uranium by pulverizing black slate containing uranium, placing the black slate powder and water in a reaction bath, and performing uranium leaching by adding and mixing sulfuric acid and an oxidant with the black slate powder and water to prepare a mixture in the reaction bath while applying ultrasound to the reaction bath. In this method, uranium leaching efficiency can be maximized by adding sulfuric acid to the uranium ore while applying ultrasound thereto.

9 Claims, 2 Drawing Sheets

OTHER PUBLICATIONS

Kyeong Woo Chung et al., "Uranium adsorption behavior on anionic exchange resin under ultrasound application", 6$^{th}$ ICSST, Oct. 27, 2010, Korea Institute of Geoscience & Mineral Resources, Changsha, Hunan, China.

Ho-Sung Yoon et al., "The effect of Sonication Intensity on the Leaching of low-grade Uranium Ore", 6$^{th}$ ICSST, Oct. 27, 2010, Korea Institute of Geoscience & Mineral Resources, Changsha, Hunan, China.

* cited by examiner

HIGHLY EFFICIENT URANIUM LEACHING METHOD USING ULTRASOUND

CROSS-REFERENCE TO RELATED APPLICATIONS

This application claims priority to and the benefit of Korean Patent Application No. 10-2010-0119086 filed on Nov. 26, 2010, the contents and teachings of which are hereby incorporated by reference in their entirety.

BACKGROUND

1. Technical Field

The present invention relates to a uranium leaching method and, more particularly, to a highly efficient uranium leaching method using ultrasound, which may improve uranium leaching efficiency by adding sulfuric acid to uranium ore while applying ultrasound thereto.

2. Description of the Related Art

When uranium ore is leached in a sulfuric acid solution, uranium oxide contained in the uranium ore is oxidized into uranium oxide cations ($UO_2^{2+}$) by trivalent iron ions ($Fe^{3+}$) and leaches in the solution.

When black slate uranium ore is added to and leached in a sulfuric acid solution, iron components contained in the black slate ore must be preferentially dissolved in the sulfuric acid solution to oxidize uranium, so that uranium leaches in the solution. However, since such a process is very slowly carried out for about a few dozen to hundreds of hours, not only does this process take too much time in uranium leaching, a low leaching rate is also obtained.

BRIEF SUMMARY

One aspect of the present invention is to provide a highly efficient uranium leaching method capable of maximizing uranium leaching efficiency by mixing water, sulfuric acid, an oxidant and iron sulfate with uranium ore for uranium leaching while applying ultrasound during the uranium leaching.

Another aspect of the present invention is to provide a highly efficient uranium leaching method capable of maximizing uranium leaching efficiency, which includes placing a mixture of black slate uranium ore powder and water in a reaction bath and performing uranium leaching by adding sulfuric acid and an oxidant to the mixture while simultaneously applying ultrasound to the reaction bath.

In accordance with one embodiment of the invention, a highly efficient uranium leaching method includes mixing water, sulfuric acid, an oxidant and iron sulfate with uranium ore to prepare a mixture to allow uranium leaching while applying ultrasound during the uranium leaching.

The mixture may be adjusted to have a pH of 1 to 2 and an oxidation-reduction potential of 450 to 600 mV during the uranium leaching.

The pH of the mixture may be adjusted by the sulfuric acid, and the oxidation-reduction potential of the mixture may be controlled by an added amount of oxidant.

The iron sulfate may be added in an amount of 2 to 5 g/l.

The uranium leaching may be carried out at a temperature of 20 to 40° C.

The mixing may include stirring the mixture at 250 to 550 rpm.

The ultrasound may be applied at an output power of 10 to 90 W.

During uranium leaching, a leaching rate may be greater than or equal to 1.0 ppm/min, and consumption of the oxidant may be less than or equal to 27.0 g/l.

The oxidant may include manganese dioxide ($MnO_2$).

The ore may include black slate.

In accordance with another embodiment of the invention, a uranium leaching method includes: preparing black slate powder containing uranium by pulverizing black slate containing uranium; placing the black slate powder and water in a reaction bath; and performing uranium leaching by adding and mixing sulfuric acid and an oxidant with the black slate powder and water to prepare a mixture in the reaction bath while applying ultrasound to the reaction bath.

The black slate powder containing uranium may be pulverized to an average particle size of 20 to 250 mesh.

Iron sulfate may be further added to the mixture in the reaction bath during the uranium leaching.

The iron sulfate may be added in an amount of 2 to 5 g/l.

The uranium leaching may be performed at a temperature of 20 to 40° C.

The oxidant may include manganese dioxide ($MnO_2$).

The mixing may include stirring the mixture at 250 to 550 rpm.

The ultrasound may be applied an output power of 10 to 90 W.

The ultrasound may be applied to the reaction bath using an ultrasonicator placed inside the reaction bath.

The ultrasound may be applied in a scanning manner in which a ultrasonicator generates the ultrasound while moving in a horizontal direction.

During uranium leaching, a leaching rate may be greater than or equal to 1.0 ppm/min, and consumption of the oxidant may be less than or equal to 27.0 g/l.

BRIEF DESCRIPTION OF THE DRAWINGS

The above and other aspects, features and advantages of the invention will become apparent from the following description of exemplary embodiments given in conjunction with the accompanying drawings, in which.

DETAILED DESCRIPTION

Figure 1:
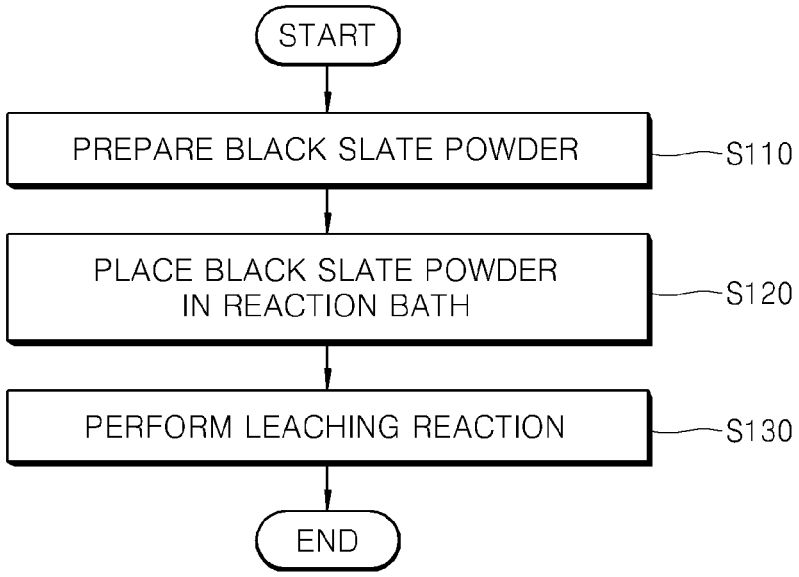
FIG. 1 is a flowchart of a highly efficient uranium leaching method using ultrasound according to an exemplary embodiment of the present invention.

Exemplary embodiments of the invention will now be described in detail with reference to the accompanying drawings. It should be understood that the present invention is not limited to the following embodiments and may be embodied in different ways, and that the embodiments are given to provide complete disclosure of the invention and to provide thorough understanding of the invention to those skilled in the art. The scope of the invention is limited only by the accompanying claims and equivalents thereof. Like components will be denoted by like reference numerals throughout the specification.

Figure 2:
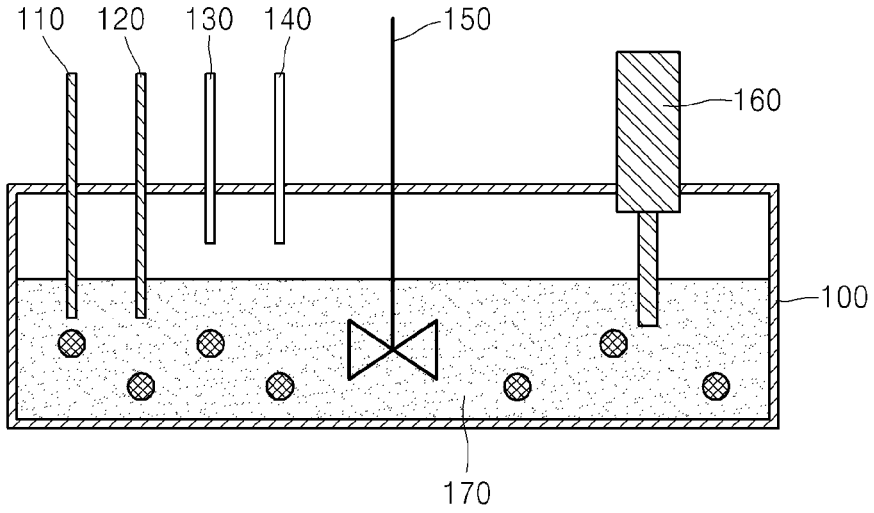
FIG. 2 is a diagram of the highly efficient uranium leaching method using ultrasound according to the exemplary embodiment of the present invention.

FIG. 1 is a flowchart of a highly efficient uranium leaching method using ultrasound according to an exemplary embodiment of the present invention, and FIG. 2 is a diagram of the highly efficient uranium leaching method using ultrasound according to the exemplary embodiment of the present invention.

Referring to FIGS. 1 and 2, the highly efficient uranium leaching method using ultrasound according to an exemplary embodiment includes preparing black slate powder in S110, placing the black slate powder in a reaction bath in S120, and performing leaching in S130.

Preparation of Black Slate Power

In operation S110, black slate containing uranium is pulverized to prepare black slate powder containing uranium.

Here, the black slate powder may have an average particle size of 20 to 250 mesh. If the average particle size of the black slate powder is less than 20 mesh, pulverizing the black slate costs too much, and if the average particle size of the black slate powder exceeds 250 mesh, insufficient leaching is obtained.

Placing Black Slate Powder in Reaction Bath

In operation S120, the black slate powder containing uranium and water are placed in the reaction bath 100.

At this time, an adequate amount of black slate powder and water may be supplied into the reaction bath 100 so as not to flow out of from the reaction bath 100.

The reaction bath 100 may be provided with an oxidation-reduction potential electrode 110 and a pH electrode 120. The oxidation-reduction potential electrode 110 and the pH electrode 120 may be positioned to face each other.

Near the oxidation-reduction potential electrode 110 and the pH electrode 120, the reaction bath may be further provided with a sulfuric-acid inlet 130 and an oxidant inlet 140 through which sulfuric acid and an oxidant are supplied into the reaction bath, respectively. Although not shown in the drawings, the reaction bath may be further provided with an iron-oxide inlet (not shown) for supplying iron oxide near the oxidation-reduction potential electrode 110 and the pH electrode 120.

Uranium Leaching

In operation S130, uranium leaching is performed by adding and mixing sulfuric acid and an oxidant with the slate powder and water to prepare a mixture in the reaction bath 100 while applying ultrasound to the reaction bath 100.

At this time, iron sulfate may be further added to the reaction bath 100. The iron sulfate may be added to an amount of 2 to 5 g/l. The sulfuric acid, the oxidant, and the iron sulfate may be added to the uranium ore and water in the reaction bath 100 through the sulfuric-acid inlet 130, the oxidant inlet 140 and the iron-sulfate inlet, respectively.

If the added amount of iron sulfate is less than 2 g/l with respect to the whole mixture 170 in the reaction bath 100, the added iron sulfate provides insignificant uranium leaching. On the other hand, if the added amount of iron sulfate exceeds 5 g/l, there can be a problem of cost increase.

The mixture 170 may be adjusted to have a pH of 1 to 2 and an oxidation reduction potential (ORP) of 450 to 600 mV. Here, the pH of the mixture may be adjusted by adding sulfuric acid and the oxidation reduction potential may be adjusted by the added amount of oxidant.

Here, manganese dioxide ($MnO_2$) may be used as the oxidant. Further, the uranium leaching may be performed at a temperature of 20 to 40° C. and the mixture may be stirred at 250 to 550 rpm.

As such, the mixture 170 supplied to the reaction bath 100 may be stirred for a predetermined period of time by rotating a stirring bar 250 at a stirring rate set to prevent the mixture from flowing out of from the reaction bath 100.

Also, uranium leaching is carried out for 0.1 to 3 hours. In this embodiment, reduction in uranium leaching time to three hours or less can be achieved by cavitation effects resulting from application of ultrasound, as will be described below in more detail.

In the uranium leaching method according to the embodiment, when the black slate powder containing uranium is leached with sulfuric acid and iron sulfate, $UO_2$ is oxidized into $UO_2^{2+}$ by $Fe^{3+}$. At this time, trivalent iron ions included in the black slate powder can participate in the uranium leaching.

That is, when uranium leaching occurs in trivalent iron ions existing in the mixture obtained by mixing water, sulfuric acid, an oxidant and iron sulfate with the black slate powder containing uranium, reactions represented by Reaction Formulas 1 and 2 occur:

$$FeS+4O_2+2H_2SO_4 \rightarrow FeSO_4+2H_2SO_4 \quad (1)$$

$$2FeS_2+7O_2+2H_2O \rightarrow 2FeSO_4+2H_2SO_4 \quad (2)$$

The dissolved $FeSO_4$ is changed into $Fe_2(SO_4)_3$ by the oxidant and there can be reactions represented by Reaction Formulas 3, 4 and 5.

$$4FeSO_4+O_2+2H_2SO_4 \rightarrow 2Fe_2(SO_4)_3+2H_2O \quad (3)$$

$$2FeSO_4+MnO_2+2H_2SO_4 \rightarrow Fe_2(SO_4)_3+MnSO_4+2H_2O \quad (4)$$

$$UO_2+Fe_2(SO_4)_3 \rightarrow UO_2SO_4+2FeSO_4 \quad (5)$$

Further, the uranium leaching may include a reaction represented by Reaction Formula 6:

$$UO_2+2Fe^{3+} \rightarrow UO_2^{2+}+2Fe^{2+} \quad (6)$$

As a result, $Fe_2(SO_4)_3$ dissolves uranium.

Meanwhile, in the highly efficient uranium leaching method according to the embodiment, the uranium leaching is carried out by applying ultrasound to the reaction bath 100 while mixing the sulfuric acid and the oxidant with the black slate powder and water in the reaction bath 100.

At this time, ultrasound may be applied at an output power of 10 to 90 W. If ultrasound is applied at an output power less than 10 W, there is a possibility of insufficient uranium leaching due to insignificant cavitation effects upon application of ultrasound. On the other hand, if ultrasound is applied at an output power exceeding 90 W, the leached amount of uranium can decrease.

Thus, when ultrasound is continuously applied to the mixture during the uranium leaching, the leaching rate increases due to increase in frequency of effective collision and improvement of mixing efficiency by cavitation, so that leaching of uranium can be maximized, thereby reducing time for the uranium leaching.

In particular, during the leaching reaction, application of ultrasound may be performed using an ultrasonicator 160 with a tip of the ultrasonicator 150 placed inside the reaction bath 100. As such, when the tip of the ultrasonicator 160 is placed inside the reaction bath 100 and directly irradiates ultrasound to the mixture, ultrasound applied to the mixture 170 is sufficiently strong to maximize the effects of ultrasonication.

At this time, ultrasound may be applied in a scanning manner in which the ultrasonicator 160 applies ultrasound to the mixture while moving. Such a scanning manner can uniformly apply ultrasound to the mixture throughout the reaction bath 100.

In the case where the uranium leaching is carried out by the uranium leaching method using ultrasound, a leaching rate of 1.0 ppm/min or higher and oxidant consumption of 27.0 g/l can be achieved.

As such, according to the embodiments of the invention, uranium leaching is carried out by mixing water, sulfuric acid, an oxidant and iron sulfate with uranium ore in a reaction bath while continuously applying ultrasound to the reaction bath, thereby maximizing uranium leaching with only a small amount of oxidant through increase in frequency of effective collision and improvement in mixing efficiency by cavitation.

EXAMPLE

Black slate powder containing uranium was prepared by pulverizing 600 g of black slate containing uranium to a particle size of 40 mesh. Then, 400 g of distilled water, 1.5 g/l of iron sulfate and sulfuric acid were added to the black slate powder to prepare a mixture. Uranium leaching was carried out for 2 hours while stirring the mixture at 400 rpm while continuously applying ultrasound to the mixture. The leaching reaction was carried out at a temperature of 30° C., and the pH and the oxidation-reduction potential of the mixture were adjusted to 2.0 and 550 mV by adding sulfuric acid and manganese dioxide to the mixture during the leaching reaction. Leaching was carried out for a total of 2 hours. During the leaching reaction, a sample solution was taken from the mixture every 30 minutes or 1 hour and filtered for inductively coupled plasma (ICP) analysis to determine uranium leaching rate.

COMPARATIVE EXAMPLE

Black slate powder containing uranium was prepared by pulverizing 600 g of black slate containing uranium to a particle size of 40 mesh. Then, 400 g of distilled water, 3.5 g/l of iron sulfate and sulfuric acid were added to the black slate powder to prepare a mixture. Uranium leaching was carried out for 3 hours while stirring the mixture at 400 rpm without applying ultrasound. The leaching reaction was carried out at a temperature of 30° C., and the pH and the oxidation-reduction potential of the mixture were adjusted to 2.0 and 550 mV by adding sulfuric acid and manganese dioxide to the mixture during the uranium leaching. Leaching was carried out for a total of 3 hours. During the leaching reaction, a sample solution was taken from the mixture every 30 minutes or 1 hour and filtered for ICP analysis to determine uranium leaching rate.

Figure 3:
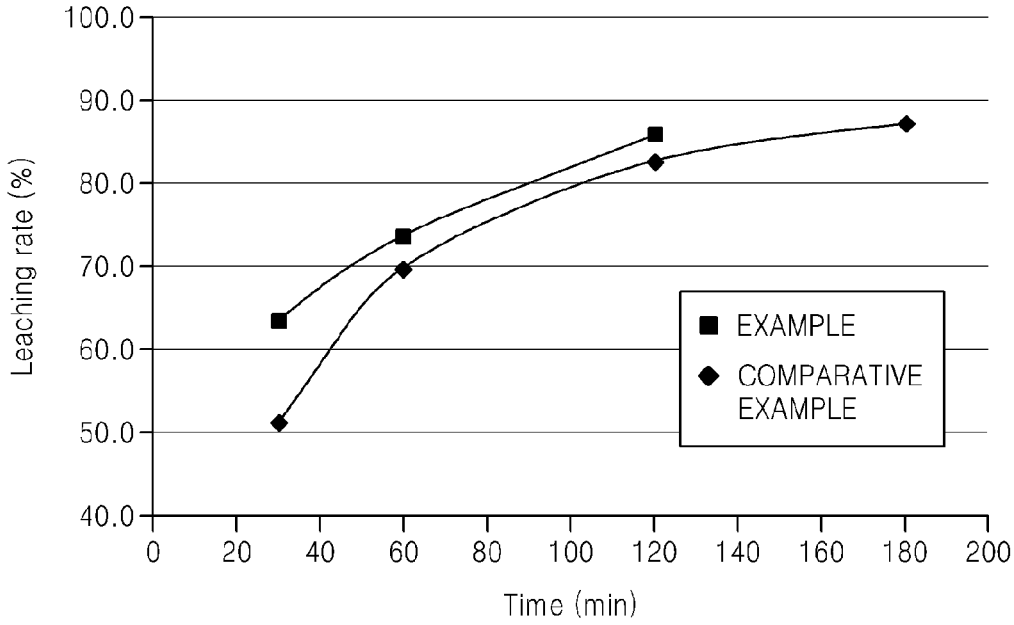
FIG. 3 is a graph depicting uranium leaching rate according to leaching time for an example and a comparative example.
Figure 4:
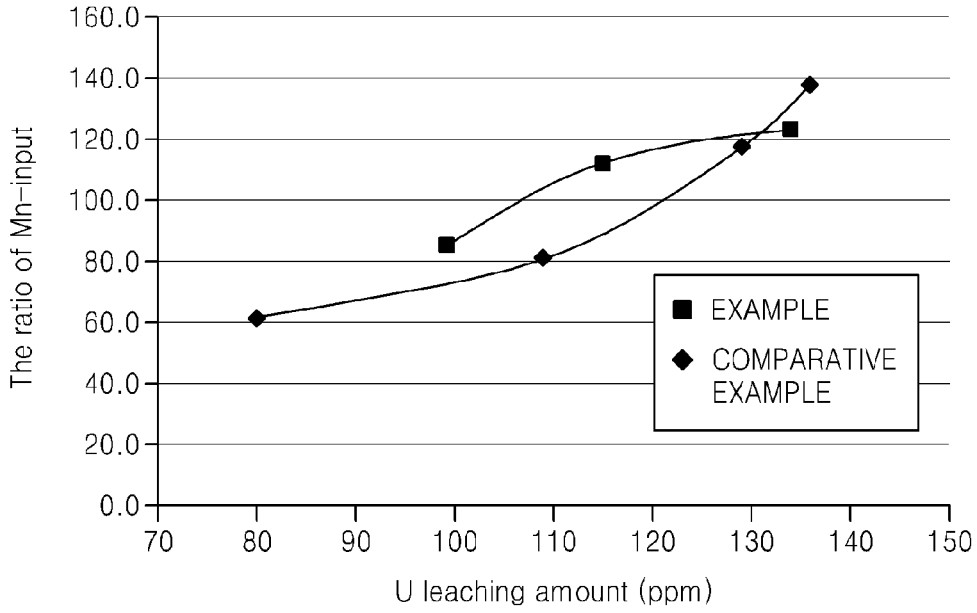
FIG. 4 is a graph showing the amount of oxidant according to the amount of leached uranium for the example and the comparative example.

FIG. 3 is a graph depicting uranium leaching rate according to leach time for an example and a comparative example, and FIG. 4 is a graph showing the amount of oxidant according to the amount of leached uranium for the example and the comparative example.

From FIG. 3, it can be ascertained that, although the added amount of iron sulfate in the example is less than that in the comparative example, the uranium leaching rate was generally increased as time passed.

Further, in FIG. 4, it can be seen that, for the example, the added amount of oxidant was gradually increased corresponding to the leached amount of uranium, but decreased due to an increase in amount of oxidant participating in a reaction when the added amount of oxidant exceeds a predetermined amount. On the other hand, it can be seen that, for the comparative example, the added amount of oxidant continued to increase in proportion to the leached amount of uranium.

Table 1 shows leaching rate, and consumption and percent of oxidant of the example compared with those of the comparative example.

TABLE 1

| Kind | Leaching rate | $MnO_2$ consumption | $MnO_2$ percent |
|---|---|---|---|
| Comparative Example | 0.76 ppm/min | 29.7 g/Kg | 62.3% |
| Example | 1.12 ppm/min | 26.1 g/Kg | 68.2% |

Referring to Table 1, the example has a leaching rate of 1.12 ppm/min, which is about 47% higher than the leaching rate of 0.76 ppm/min in the comparative example. Also, oxidant consumption in the example is about 3.6 g/Kg lower than in the comparative example. Further, the percent of oxidant used in the example is 5.9% higher than in the comparative example.

According to the experimental results, it can be seen that application of ultrasound to the mixture results in increase in the uranium leaching rate, as compared with the case where ultrasound is not applied to the mixture, and that the consumption of oxidant decreases with increasing percent of additive oxidant actually used in the reaction.

Accordingly, when uranium is leached by the highly efficient uranium leaching method using ultrasound according to the exemplary embodiment, it is possible to maximize uranium leaching while using a small amount of oxidant.

Although some embodiments have been described herein, it should be understood by those skilled in the art that these embodiments are given by way of illustration only, and that various modifications, variations, and alterations can be made without departing from the spirit and scope of the invention. Therefore, the scope of the invention should be limited only by the accompanying claims and equivalents thereof.

What is claimed is:

1. A uranium leaching method comprising:

mixing water, sulfuric acid, manganese dioxide (MnO2) as an oxidant, and iron sulfate in an amount of 2 to 5 g/l with uranium ore to prepare a mixture for uranium leaching while applying ultrasound during the uranium leaching, wherein an oxidation-reduction potential is 450 to 600 mV during the uranium leaching, wherein the uranium leaching is carried out at a temperature of 20 to 40° C., wherein the ultrasound is applied at an output power of 10 to 90 W during the uranium leaching, and wherein consumption of the oxidant is controlled to be equal to or less than 27.0 g per 1 Kg of uranium during the uranium leaching.

2. The method of claim 1, wherein the mixture is adjusted to have a pH of 1 to 2.

3. The method of claim 2, wherein the pH of the mixture is adjusted by the sulfuric acid and the oxidation-reduction potential of the mixture is adjusted by an added amount of oxidant.

4. The method of claim 1, wherein the mixing comprises stirring the mixture at 250 to 550 rpm.

5. The method of claim 1, wherein the ore comprises black slate.

6. A uranium leaching method comprising:

Preparing a black slate powder containing uranium by pulverizing black slate containing uranium;

placing the black slate powder and water in a reaction bath; and performing uranium leaching by adding and mixing sulfuric acid, manganese dioxide (MnO2) as an oxidant, and iron sulfate in an amount of 2 to 5 g/l with the black slate powder and water in the reaction bath while applying ultrasound to the reaction bath, wherein the black slate powder containing uranium is pulverized to an average particle size of 20 to 250 mesh, wherein the uranium leaching is performed at a temperature of 20 to 40° C., wherein an oxidation-reduction potential is 450 to 600 mV during the uranium leaching, wherein the ultrasound is applied at an output power of 10 to 90 W during the uranium leaching, and wherein consumption of the oxidant is controlled to be equal to or less than 27.0 g per 1 Kg of uranium during the uranium leaching.

7. The method of claim 6, wherein the mixing comprises stirring the mixture at 250 to 550 rpm.

8. The method of claim 6, wherein the ultrasound is applied to the reaction bath using an ultrasonicator placed inside the reaction bath.

9. The method of claim 8, wherein the ultrasound is applied in a scanning manner in which the ultrasonicator generates ultrasound while moving in a horizontal direction.

* * * * *